US005106330A

United States Patent [19]

Nelson et al.

[11] Patent Number: 5,106,330

[45] Date of Patent: Apr. 21, 1992

[54] EXHAUST RELIEF SYSTEM WITH BAFFLE

[75] Inventors: Dan E. Nelson, Wildwood; Louis R. Neal, Zion; Charles F. Erbach, Gurnee, all of Ill.; Craig A. Cantrell, Kenosha, Wis.; Chunyuen R. Cheng, Vernon Hills, Ill.

[73] Assignee: Outboard Marine Corporation, Waukeang, Ill.

[21] Appl. No.: 589,430

[22] Filed: Sep. 28, 1990

[51] Int. Cl.[5] ..... B63H 21/32; B63H 21/34; B63H 21/38

[52] U.S. Cl. ..... 440/89; 440/88; 60/321; 60/312; 181/272; 181/235

[58] Field of Search ..... 440/89, 88; 181/272, 181/235; 115/73; 60/301, 312

[56] References Cited

U.S. PATENT DOCUMENTS

| | | | |
|---|---|---|---|
| 3,967,446 | 7/1976 | Harralson et al. | 440/89 |
| 4,145,988 | 3/1979 | Harada | 115/73 |
| 4,303,401 | 12/1981 | Sanmi et al. | 440/88 |
| 4,354,849 | 10/1982 | Sanmi et al. | 440/89 |
| 4,421,490 | 12/1983 | Nakahama | 440/89 |
| 4,507,092 | 3/1985 | Hall et al. | 440/89 |
| 4,601,666 | 7/1986 | Wood, Jr. | 440/89 |
| 4,604,069 | 8/1986 | Taguchi | 440/88 |
| 4,607,723 | 8/1986 | Okazaki | 181/272 |
| 4,668,199 | 5/1987 | Freund et al. | 440/89 |
| 4,684,351 | 8/1987 | Watanabe et al. | 440/89 |
| 4,790,134 | 12/1988 | Johnson | 60/321 |
| 4,795,383 | 1/1989 | Binversie et al. | 440/89 |
| 4,799,905 | 1/1989 | Broughton et al. | 440/89 |
| 4,887,692 | 12/1989 | Outani et al. | 181/235 |
| 4,917,640 | 4/1990 | Miles, Jr. | 440/89 |

*Primary Examiner*—Joseph F. Peters, Jr.
*Assistant Examiner*—Kenneth Lee
*Attorney, Agent, or Firm*—Michael, Best & Friedrich

[57] ABSTRACT

The invention provides a marine propulsion device comprising a powerhead including an exhaust gas discharge port, a gearcase rotatably supporting a propeller shaft connected to the powerhead and including an exhaust gas discharge, and a lower unit including an upper portion supporting the powerhead and a lower portion connected to the gearcase, with the lower unit comprising an inner exhaust housing having a generally vertical wall, an open top in communication with the powerhead exhaust gas discharge port, a bottom having therein a first exhaust gas outlet and a second exhaust gas outlet at the top portion of the wall, and an outer exhaust housing also having a generally vertical wall in surrounding relation to the inner exhaust gas housing and defining a vertically extending generally annular space between the inner and outer exhaust gas housings, the space communicating with the second exhaust gas outlet. A water pump, driven by the powerhead, supplies water to the powerhead and to the space between the inner and outer exhaust gas housings. A means for varying the water in the space between the inner and outer exhaust gas housings between a first lower level and a second upper level responds to an operating condition in the powerhead, and an idle exhaust gas discharge means operates only when the water in the annular space between the inner exhaust housing and the outer gas housing is at the first lower level.

22 Claims, 2 Drawing Sheets

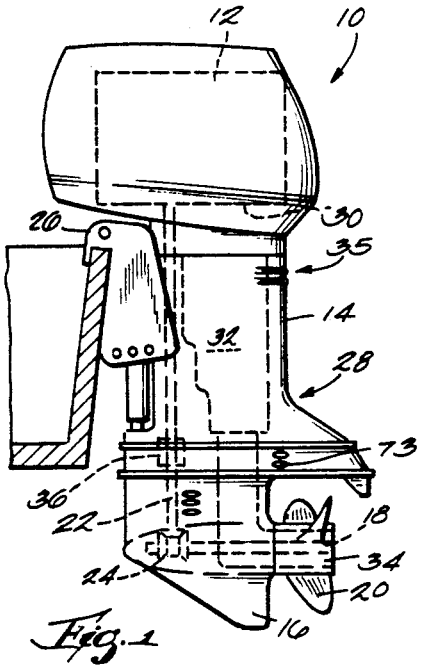
Fig. 1
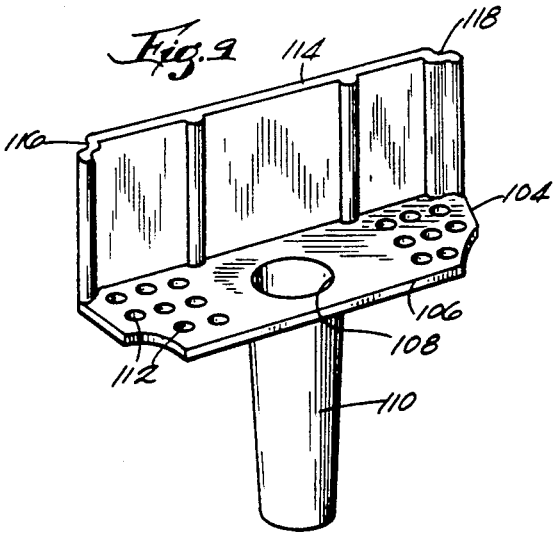
Fig. 2
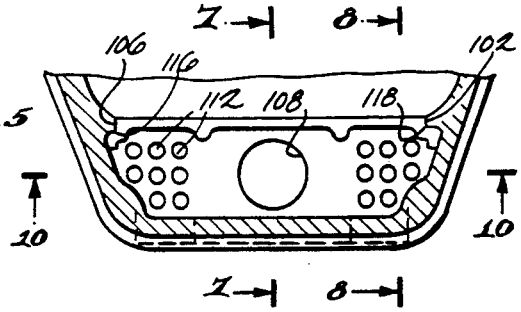
Fig. 5
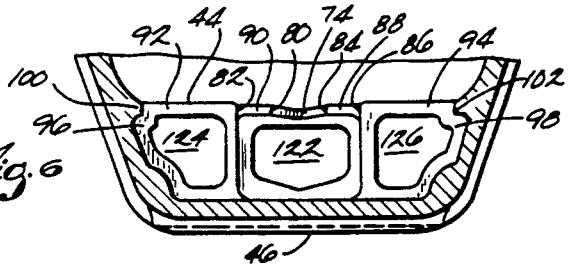
Fig. 6
Fig. 8
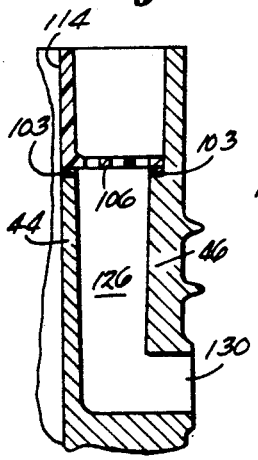
Fig. 7
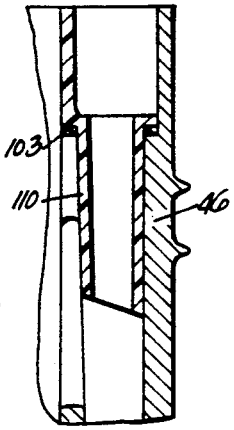
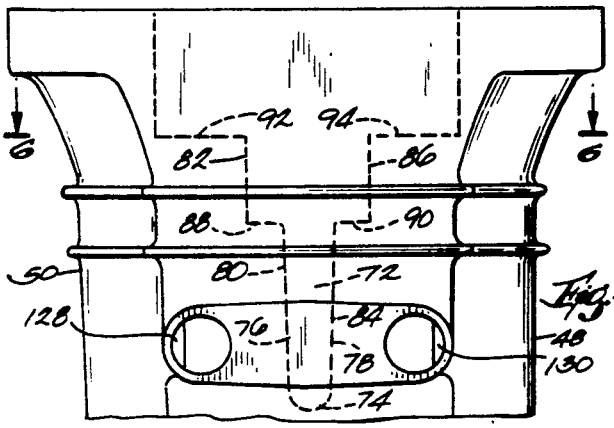
Fig. 4

EXHAUST RELIEF SYSTEM WITH BAFFLE

BACKGROUND OF THE INVENTION

This invention relates to marine propulsion devices such as outboard motors, and more particularly to water jacketed exhaust discharge systems including an exhaust gas relief arrangement.

Exhaust gas from outboard motor internal combustion engines typically is directed downwardly through a gas expansion chamber in a drive shaft housing and then discharged into the water through a through-the-hub propeller or the like. The exhaust gas expansion chamber is jacketed with water to cool the exhaust gases and muffle the sound.

At higher boat speeds, a low pressure region is created behind the propeller and exhaust gases are easily discharged into the water. At engine idle or lower boat speeds, water backs up through the hub into the exhaust gas expansion chamber and creates a static back pressure which restricts the discharge of exhaust gases and creates rough engine operating characteristics if those exhaust gases are not allowed escape through an alternative means.

Exhaust relief systems, or secondary exhaust discharge means have been provided for venting the exhaust gases to atmosphere during engine idle and low boat speeds through a discharge outlet located in the drive shaft housing or lower unit generally above the water line when the boat and outboard motor is at rest or at low speeds. These secondary exhaust discharge systems also generally allow at least some exhaust to be vented during high speed operation. Examples of prior art constructions including exhaust relief systems are disclosed in the following U.S. patents:

| PATENT NUMBER | INVENTOR(S) | ISSUE DATE |
|---|---|---|
| 3,967,446 | Harralson, J. H.<br>Wurzbach, W. F. | 7/6/76 |
| 4,145,988 | Harada, Norimichi | 3/27/79 |
| 4,303,401 | Sanmi, Yasumaru<br>Harada, Norimichi<br>Nishida, Yasuhiro | 12/1/81 |
| 4,354,849 | Sanmi, Yasumaru<br>Harada, Norimichi<br>Nishida, Yasuhiro | 10/19/82 |
| 4,421,490 | Nakahama, Ryoji | 12/20/83 |
| 4,604,069 | Taguchi, Michihiro | 8/5/86 |
| 4,607,723 | Okazaki, Masaki | 8/26/86 |
| 4,668,199 | Freund, M. A.<br>Jennerjahn, P. H.<br>Kusche, D. W. | 5/26/87 |
| 4,684,351 | Wantanabe, Yoshimi<br>Yamashita, Kazuya | 8/4/87 |
| 4,790,134 | Johnson, C. A. | 12/13/88 |
| 4,795,383 | Binversie, G. J.<br>Gerdes, R. W.<br>Macier, J. E. | 1/3/89 |
| 4,799,905 | Broughton, G. L.<br>Rogers, D. E.<br>Mate, D. W. | 1/24/89 |
| 4,887,692 | Outani, Hiroaki<br>Inoue, Seiji | 12/19/89 |
| 4,917,640 | Miles, C. C. Jr. | 4/17/90 |

SUMMARY OF THE INVENTION

The invention provides a marine propulsion device comprising a powerhead, a gearcase rotatably supporting a propeller shaft connected to the powerhead, a lower unit including an upper portion supporting the powerhead and lower portion connected to the gearcase. The lower unit comprises an inner exhaust housing having a generally vertical wall an outer exhaust housing also having a generally vertical wall in surrounding relation to the inner exhaust housing and defining a vertically extending generally annular space between the inner and outer exhaust housings. A water pump, driven by the powerhead, supplies water to cool the powerhead during operation and also supplies water to the annular space between the inner and outer exhaust housings. A means for discharging water from the annular space between the inner and outer exhaust housings includes a slot in the upper portion of the wall of the outer exhaust housing. The slot has a bottom and two side walls, each of the side walls having a lower portion and an upper portion, with a first distance between the lower portions of the side walls and second distance between the upper portions of the side walls.

The invention also provides a marine propulsion device comprising a powerhead operable between a low idle speed and a high wide open throttle speed and including an exhaust gas discharge port, a gearcase rotatably supporting a propeller shaft connected to the powerhead including an exhaust gas discharge, a lower unit having an upper portion supporting the powerhead and lower portion connected to the gearcase and defining a volume between the upper and lower portions and including an idle exhaust gas outlet, and an idle exhaust gas means automatically operable to allow exhaust gas to pass from the discharge port to the idle exhaust outlet only upon powerhead low idle speed.

The invention also provides a marine propulsion device comprising a powerhead including an exhaust gas discharge port, a gearcase rotatably supporting a propeller shaft connected to the powerhead and including an exhaust gas discharge, and a lower unit including an upper portion supporting the powerhead and a lower portion connected to the gearcase, with the lower unit comprising an inner exhaust housing having a generally vertical wall, an open top in communication with the powerhead exhaust gas discharge port, a bottom having therein a first exhaust gas outlet and a second exhaust gas outlet at the top portion of the wall, and an outer exhaust housing also having a generally vertical wall in surrounding relation to the inner exhaust gas housing and defining a vertically extending generally annular space between the inner and outer exhaust gas housings, the space communicating with the second exhaust gas outlet. A water pump, driven by the powerhead, supplies water to the powerhead and to the space between the inner and outer exhaust gas housings. A means for varying the water in the space between the inner and outer exhaust gas housings between a first lower level and a second upper level responds to an operating condition in the powerhead, and an idle exhaust gas discharge means operates only when the water in the annular space between the inner exhaust housing and the outer gas housing is at the first lower level.

The invention also provides that the means for varying the water level in the space between the inner and outer exhaust housings comprises a slot in the upper portion of the wall of the outer exhaust housing with the slot having a bottom and two side walls, each of the side walls having a lower portion and an upper portion and the slot having a first distance between the lower portions of the side walls and a second distance between the upper portions of the side walls.

The invention also provides for an exhaust gas discharge means including an upper chamber, a lower chamber communicating with the space between the inner and outer exhaust gas housings via the slot, a horizontal wall separating the chambers, an aperture in the wall, a hollow cylindrical pipe depending from the wall around the aperture into the lower chamber, with the pipe having a lower end which is above the first level but below the second level.

The invention also provides that the wall and the pipe of the exhaust gas discharge means are made up of a unitary piece of plastic and are held in place by the connection of the lower unit to the powerhead.

The invention also provides for a baffle including the horizontal wall and cylindrical pipe and a vertical wall extending upwardly from the horizontal wall wherein the power head includes a lower end and wherein the upper chamber is defined by the vertical wall of the baffle, the lower end of the powerhead and the outer exhaust housing.

The invention also provides for a marine propulsion device comprising a powerhead including a lower end having therein an exhaust gas discharge port, a lower unit including an inner exhaust housing having an upper end communicating with the port and an outer exhaust housing surrounding the inner exhaust housing and having an upper end connected to the lower end of the powerhead, a propeller shaft rotatably supported by the lower unit, and an exhaust conduit which communicates with the inner exhaust housing and which is secured relative to the outer exhaust housing solely by being captured between the outer exhaust housing and the lower end of the powerhead.

BRIEF DESCRIPTION OF THE DRAWINGS

FIG. 1 is a side elevational view of a marine propulsion device constructed in accordance with the invention.

FIG. 4 is a rear view of the upper portion of the lower unit with portions shown in phantom.

FIG. 5 is a top view of the rear portion of the lower unit with the baffle in place and portions shown in phantom.

FIG. 6 is a sectional view taken along lines 6—6 of FIG. 4.

FIG. 7 is a partial cross sectional view taken along lines 7—7 of FIG. 5.

FIG. 8 is a partial cross sectional view taken along lines 8—8 of FIG. 5.

FIG. 9 is a detail view of the polymer partition or baffle.

Figure 3:
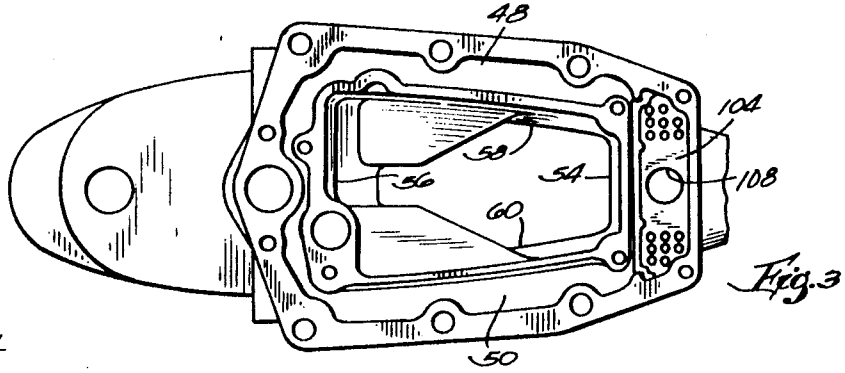
FIG. 3 is a plan view of the lower unit.

Before explaining at least one of the embodiments of the invention in detail, it is to be understood that the invention is not limited in its application to the details of the construction and the arrangement of the components set forth in the following description or illustrated in the drawings. The invention is capable of other embodiments and of being practiced and carried out in various ways. Also it is to be understood that the phraseology and terminology employed herein is for the purpose of description and should not be regarded as limiting.

DESCRIPTION OF THE PREFERRED EMBODIMENT

Illustrated in FIG. 1 is a marine propulsion device in the form of an outboard motor 10 having a propulsion unit or powerhead 12, a lower unit 14, and a gearcase 16 rotatably supporting a propeller shaft 18 to which is connected a propeller 20. The propeller shaft 1 is connected to the powerhead by means of a transmission means 24 and a driveshaft 22 so that the powerhead will drivingly rotate the propeller 20. Also included in the marine propulsion device is a means for attaching the outboard to the transom of the boat including a stern bracket 26.

The marine propulsion device also includes an exhaust system 28 having an exhaust port 30 from the powerhead emptying exhaust gas from the powerhead into an expansion chamber 32 in the lower unit. A first exhaust discharge means 34 extends from the bottom of the expansion chamber, through the gearcase 16 and through the hub of the propeller 20.

As stated earlier, when the marine propulsion device is operating at a relatively high speed, a lower pressure area is located behind the propeller 20 and the exhaust gases from the powerhead will be discharged into the water in which the marine propulsion device is operating in the area behind the propeller. Also included in the exhaust system 28 is a second or idle exhaust discharge means 35 which will be described in more detail.

The marine propulsion device also includes a water pump 36 which supplies water from the medium in which the marine propulsion device 10 is operating to cool the powerhead 12 and the exhaust system 28. The cooling water is then allowed to be dumped back into the medium. In one embodiment, the water pump is drivingly connected to the driveshaft 36 and the amount of water pumped by the water pump 36 and thus flowing through the cooling system varies with the speed of the powerhead, with more water flowing as the powerhead speed increases.

Figure 2:
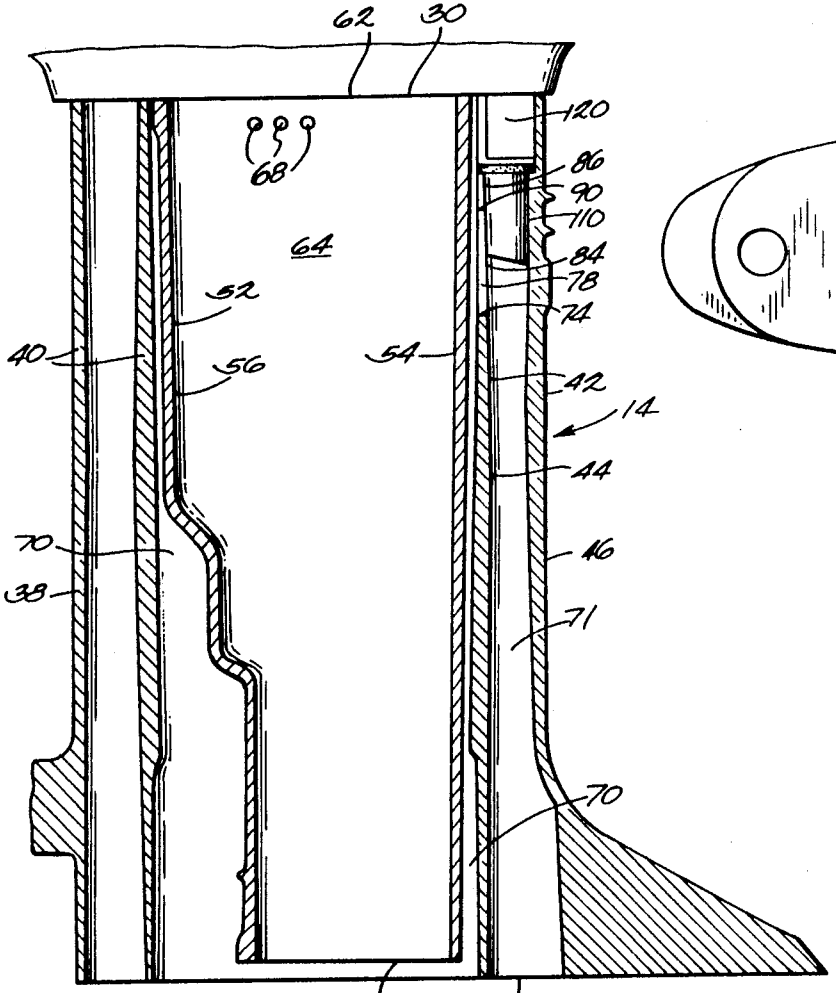
FIG. 2 is a sectional view of the lower unit of the marine propulsion device of FIG. 1.

FIG. 2 shows a more detailed sectional view of the lower unit 14 of the marine propulsion device 10. The lower unit includes an outer exhaust housing 38 which, in one preferred embodiment comprises a front wall 40 which has an inner and an outer portion along the centerline. The outer exhaust housing also comprises a back wall 42 which has an inner portion 44 and an outer portion 46 throughout much of the cross section. The outer exhaust housing also comprises a right side wall 48 and a left side wall 50, as shown in FIG. 3.

Positioned inside of the outer exhaust housing 38 is an inner exhaust housing 52. In a preferred embodiment, the inner exhaust housing also comprises a generally vertical rear wall 54, a front wall 56, a right side wall 58, and a left side wall 60. The four walls of the inner exhaust housing 52 combine to form a chamber 64 into which exhaust from the powerhead exhaust port 30 enters through an exhaust gas inlet 62 at its upper end. The inner exhaust housing also comprises a first exhaust gas outlet 66 at its lower end which communicates with the first exhaust gas discharge means 34 for discharging exhaust gas through the propeller hub. The inner exhaust housing 52 also comprises a second exhaust gas outlet 68 near the upper portion thereof communicating with the second exhaust discharge means 35 to be more fully described later. In a preferred embodiment, the second exhaust gas outlet 68 includes a plurality of holes in the inner exhaust housing in each of the side walls 58 and 60.

Between the inner and outer exhaust housings is a generally annular and vertically extending space 70. Water from the water pump 36 enters into the space 70 to cool the inner exhaust housing from the hot exhaust gases. The upper level of the water is controlled by the slot 72 (see FIGS. 2, 4 and 10) in the inner portion 44 of the rear wall 42 of the outer exhaust housing 38. Water from the space 70 passes through the slot 72 into the generally vertical space 71 between the inner portion 44 and the outer portion 46 of the rear wall 42 of the outer exhaust housing 38. At the bottom of the space 71 is a cooling water discharge 73 which dumps the cooling water back into the medium in which the outboard is operating. Exhaust gas also occupies the upper portion of the space 70, or the volume not occupied by water, by entering through the second exhaust gas outlet 68 of the inner exhaust housing 52.

The slot comprises a bottom 74, a left side wall 76 and a right side wall 78. The left side wall 76 has a lower portion 80 and an upper portion 82 and the right side wall also comprises a lower portion 84 and an upper portion 86. The slot is defined by a first shorter distance between the lower portions of the side walls 80 and 84 and a second larger distance between the upper portions of the side walls in a preferred embodiment. The top of the lower portions of the side walls and the bottoms of the upper portions of the side walls are connected by horizontal walls 88 and 90.

The top of each of the upper walls 82 and 86 terminate in horizontal ledges 92 and 94 (see FIGS. 4 and 6) extending outwardly from each wall. Each ledge 92 and 94 comprises a generally annular surface 96 and 98 on either side of the slot 72. Extending upward from three sides of the horizontal ledges is the outer portions 46 of the rear wall 42 and side walls 50 and 48 of the outer exhaust housing 38. At the junction of the front portion of each of the annular surfaces of the horizontal ledges and the respective side wall of the outer exhaust housing is a upwardly extending shoulder 100 and 102.

In a preferred embodiment, seated on a washer 103 on the ledges 92 and 94 is a unitary baffle and cylinder assembly 104 generally shown in FIG. 9. This assembly is preferably made of a plastic or polymer. It comprises a horizontal partition 106 having a major aperture 108 generally in its center. Depending from and connected to the partition 106 around the aperture is a hollow cylindrical pipe 110. The partition 106 also comprises a plurality of smaller apertures 112 on either side of the main center aperture 108. The baffle and cylinder assembly also comprises an upwardly extending wall 114 along one side of the partition. At either end of the wall 114 is a vertically extending groove 116 and 118.

As shown in FIG. 5, in a preferred embodiment, the baffle and cylinder assembly is slid vertically into the upper rear portion of the outer exhaust housing 38 generally between the inner 44 and outer 46 portions of the rear wall 42 by being directed by the grooves 116 and 118 fitting into the shoulders 100 and 102. The vertical wall 114 cooperates with the rear portions of the side walls 48 and 50 of the outer exhaust housing and the upper end of the outer portion 46 of the rear wall of the outer exhaust housing to form a generally rectangular upper chamber 120 having the bottom surface of the rear of the powerhead 12 as a top wall and the horizontal partition 106 as a bottom wall. By this arrangement, the baffle and cylinder assembly 104 is held in place in the lower unit by the attachment of the lower unit to the bottom of the powerhead 12.

The inner portion of the rear wall 44 of the outer exhaust housing, the vertical upper walls 82 and 86 of the slot 72, and the outer portion of the rear wall 46 also form a generally rectangular lower chamber 122. The top wall of this chamber is the bottom surface of the partition 106 and the bottom of the chamber is generally the water level in the space 71, which level is controlled by the amount of water passing though the slot 72.

During low speed powerhead operation, the amount of water pumped into the annular space 70 between the inner and outer exhaust housings by the water pump 36 is sufficiently low that it can be discharged through the space formed by the left and right lower portions 80 and 84 of the walls of the slot 72. Accordingly, the water level is maintained at or near the bottom of the slot 74. Meanwhile, the water level in the chamber 64 inside the inner exhaust housing 52 is generally determined by the level at which the marine propulsion unit 10 is sitting in the water while the powerhead is at a low speed operating condition, but is always above the bottom of the lower unit and below the idle exhaust outlet ports 128 and 130. Accordingly, in this condition, the path of least resistance for the exhaust from the powerhead is not through the first exhaust outlet 66 in the bottom of the inner exhaust housing, but through the second exhaust outlet 68 into the space 70 between the inner and outer exhaust housings.

Figure 10:
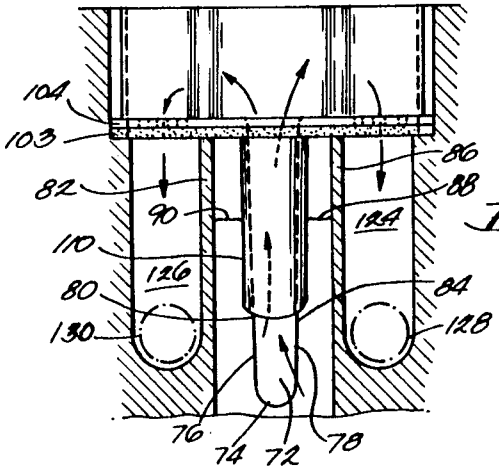
FIG. 10 is a partial sectional view taken along lines 10—10 of FIG. 5.

As shown generally in FIG. 10, since the water level in the annular space 70 and in the vertical space 71 in this first operating condition is at the bottom 74 of the slot 72 which is below the bottom of the cylinder 110, the exhaust can pass through the slot 72 from the space 70 between the inner and outer exhaust housing to the lower chamber 122 and travel up through the cylinder 110 to the upper chamber 120. The exhaust can then pass back down through the apertures 112 to the side lower chambers 124 and 126 to the idle exhaust outlet ports 128 and 130.

This passageway allows for acoustical deadening of the exhaust by providing a circuitous path, a series of chambers with varying volumes and a cylindrical pipe. Specifically, the idle exhaust is discharged from the powerhead 12 into a relatively large chamber 64, whose total volume available for exhaust will vary depending on the depth of the outboard motor in the medium in which it is sitting. The exhaust then passes though the restrictions 68 into a second volume, the space 70 between the inner and outer exhaust housings. At lower powerhead speed operations, the idle exhaust next passes though the restriction of the slot 72 into the larger volume of the lower chamber 122. The cylinder 110 acts as a tuning chamber as the exhaust passes though it and up to another larger volume, the upper chamber 120. At this point, the exhaust relief must make a sharp turn to go back down through another restriction, the small apertures 112 in the baffle 104 into another volume, the side lower chambers, 124 or 126 and finally out the idle exhaust outlet port 128 or 130.

During high speed powerhead operation, the amount of water pumped from the water pump 36 into the space 70 between the inner and outer exhaust housings is too large to entirely be able to be discharged through the area between the lower portions 80 and 84 of the slot 72. Accordingly, the level of the water rises to a second level which is at least equal to the horizontal ledges 88 and 90. As can be seen in FIG. 2 and 10, exhaust cannot easily enter into the cylinder 110 because the water level in the space 71 has raised to the point where the lower portion of the cylinder 110 is below water and thus the exhaust would have to bubble though this water to escape though the idle exhaust outlet ports 128 or 130. At this high rate of speed of powerhead operation there is also generally a low pressure formed behind the propeller 20 and water is vacated from the chamber 64 in the inner exhaust housing and exhaust can easily escape through the first exhaust discharge port 66.

By this construction, it can be seen that the idle exhaust relief or second exhaust discharge mean 35 is automatically opened, or is the path of least resistance for exhaust gases when the powerhead is in a low speed operation, but is effectively closed, or the resistance to flow is greatly increased, at higher speeds. This allows for an even low back pressure, above water exhaust at low or idle speed, but enhancement of the exhaust noise generated at high speed, as the exhaust can generally be buried in the water behind the propeller at high speed.

Various of the features of the invention are set forth in the following claims.

We claim:

1. A marine propulsion device comprising a powerhead, a gearcase rotatably supporting a propeller shaft connected to the powerhead, a lower unit including an upper portion supporting the powerhead and a lower portion connected to the gearcase, said lower unit comprising an inner exhaust housing having a generally vertical wall, and an outer exhaust housing also having a generally vertical wall in surrounding relation to the inner exhaust housing and defining a vertically extending generally annular space between the inner and outer exhaust gas housings, a water pump driven by the powerhead for supplying water to cool the powerhead during operation and for supplying water to the annular space between the inner and outer exhaust housings, and means for discharging water from the annular space between the inner and outer exhaust housings including a slot in the upper portion of said wall of the outer exhaust housing, said slot having a bottom and two side walls, each of said side walls having a lower portion and an upper portion, and said slot having a first distance between said lower portions of said side walls and a second distance between said upper portions of said side walls.

2. The marine propulsion device of claim 1 wherein exhaust gas from the powerhead is discharged into a space inside the inner exhaust housing, and said inner exhaust housing has an aperture at its upper end to allow exhaust gas to pass into said annular space between said inner and outer exhaust housings.

3. The marine propulsion device of claim 2 wherein exhaust gas occupies the volume in the annular space between said inner and outer exhaust housings not occupied by water.

4. The marine propulsion device of claim 3 wherein the level of the water in the annular space between the inner and outer exhaust housings varies between a first lower level which is at the bottom of said slot and a second higher level which is at the junction between the lower and upper portions of the side walls of said slot.

5. The marine propulsion device of claim 4 wherein said outer exhaust housing includes a first chamber and said exhaust gas is in communication with said chamber through said slot.

6. The marine propulsion device of claim 5 wherein said outer exhaust housing includes a second chamber located above said first chamber and separated from said first chamber by a partition, and means to allow said exhaust gas to be in communication with said second chamber only when said water in said annular space between the inner and outer exhaust housings is at said first lower level.

7. The marine propulsion device of claim 6 wherein the partition between the first and second chambers is made of a plastic or polymer construction and said means to allow communication includes an aperture in said partition around said cylindrical pipe depending from said partition around said aperture, said cylinder having a lower end below the second higher level of the water in the annular space between the inner and outer exhaust housings.

8. A marine propulsion device comprising a powerhead operable between a low speed and a high speed and including an exhaust gas discharge port, a gear case rotatably supporting a propeller shaft connected to the powerhead and including an exhaust gas discharge, and a lower unit having an idle exhaust gas outlet, an upper portion supporting the powerhead, a lower portion connected to the gearcase, and a space located adjacent, said upper portion, and an idle exhaust gas discharge path extending between said exhaust gas discharge port and said idle exhaust gas outlet and through said space and including means associated with said space for blocking said discharge path with water to prevent passage of exhaust gas to said idle exhaust outlet upon powerhead high speed and for allowing exhaust gas to pass to said idle exhaust gas outlet upon powerhead low speed.

9. The marine propulsion device of claim 8 wherein said lower unit further comprises an inner exhaust housing having a generally vertical wall, an open top in communication with the powerhead exhaust gas discharge port, a bottom having therein a first exhaust gas outlet, and a second exhaust gas outlet at the top portion of said wall, and an outer exhaust housing also having a generally vertical wall in surrounding relation to the inner exhaust gas housing and defining a vertically extending generally annular space between the inner and outer exhaust gas housings, said annular space forming a part of said idle exhaust gas discharge path.

10. The marine propulsion device of claim 9 wherein said means for blocking said discharge path comprises a water pump driven by the powerhead for supplying water to the power head and to said annular space between the inner and outer exhaust gas housings, and means for varying the water level in said annular space between the inner and outer exhaust housings between a first lower level and a second upper level in response to the operating conditions of the powerhead.

11. A marine propulsion device comprising a powerhead including an exhaust gas discharge port, a gearcase rotatably supporting a propeller shaft connected to the powerhead and including an exhaust gas discharge, a lower unit including an upper portion supporting the powerhead and a lower portion connected to the gearcase, the lower unit comprising an inner exhaust housing having a generally vertical wall, an open top in communication with the powerhead exhaust gas discharge port, a bottom having therein a first exhaust gas outlet, and a second exhaust gas outlet at the top portion of said wall, and an outer exhaust housing also having a generally vertical wall in surrounding relation to the inner exhaust gas housing and defining a vertically extending generally annular space between the inner and outer exhaust gas housings, said space communicating with said second exhaust gas outlet, a water pump driven by the powerhead for supplying water to the powerhead and to the space between the inner and outer exhaust gas housings, means for varying the water level in the space between the inner and outer exhaust housings between a first lower level and a second upper level in response to an operating condition of the powerhead, and an idle exhaust gas discharge means operable only when the water in the annular space between the inner exhaust housing and the outer exhaust housing is at said first lower level.

12. The marine propulsion device of claim 11 wherein said means for varying the water level in the space between the inner and outer exhaust housings comprises a slot in the upper portion of said wall of the outer exhaust housing, said slot having a bottom and two side walls, each of said side walls having a lower portion and an upper portion and said slot having a first distance between said lower portions of said side walls and a second distance between said upper portions of said side walls.

13. The marine propulsion device of claim 12 wherein said idle exhaust gas discharge means includes an upper chamber, a lower chamber communicating with said space via said slot, a horizontal partition separating the chambers, an aperture in said partition, a hollow cylindrical pipe depending from said wall around said aperture into said lower chamber, said pipe having a lower end which is above the first level, but below the second level.

14. The marine propulsion device of claim 13 wherein the wall and the pipe of the exhaust gas discharge means are made of a unitary piece of plastic and are held in place by the connection of the lower unit to the powerhead.

15. The marine propulsion device of claim 13 and further comprising a baffle including said horizontal wall, said cylindrical pipe, and a vertical wall extending upwardly from said horizontal wall, wherein said powerhead includes a lower end, and wherein said upper chamber is defined by said vertical wall of said baffle, said lower end of said powerhead, and said outer exhaust housing.

16. The marine propulsion device of claim 12 wherein said outer exhaust housing has therein an idle exhaust outlet, and wherein said horizontal wall has therein at least one exhaust passageway which is spaced from said aperture and which communicates between said upper chamber and said idle exhaust outlet.

17. The marine propulsion device of claim 16 wherein said horizontal wall has therein a plurality of said passageways.

18. The marine propulsion device of claim 16 wherein said outer exhaust housing includes an expansion chamber communicating with said idle exhaust outlet, and wherein said passageway in said horizontal wall communicates with said expansion chamber.

19. The marine propulsion device of claim 12 wherein said outer exhaust housing includes a water outlet passageway having an upper end communicating with said lower chamber.

20. A marine propulsion device comprising a powerhead including a lower end having therein an exhaust gas discharge port, a lower unit including an inner exhaust housing having an upper end communicating with said port, and an outer exhaust housing surrounding said inner exhaust housing and having an upper end connected to said lower end of said powerhead and including an upwardly open recess, a propeller shaft rotatably supported by said lower unit, and an exhaust baffle communicating with said inner exhaust housing, located in said recess in said outer exhaust housing and retained therein solely by the connection of said upper end of said outer exhaust housing and said lower end of said powerhead.

21. The marine propulsion device of claim 20 wherein the baffle comprises a vertical wall, a horizontal partition and a hollow cylindrical pipe depending from said partition.

22. The marine propulsion device of claim 21 wherein the baffle is made of a unitary piece of plastic.

* * * * *